US011551628B2

(12) United States Patent
Shan

(10) Patent No.: US 11,551,628 B2
(45) Date of Patent: Jan. 10, 2023

(54) DRIVING METHOD FOR DISPLAY PANEL, DRIVING DEVICE OF DISPLAY PANEL, AND DISPLAY APPARATUS

(71) Applicant: HKC CORPORATION LIMITED, Guangdong (CN)

(72) Inventor: Jianfeng Shan, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 17/042,926

(22) PCT Filed: Feb. 26, 2019

(86) PCT No.: PCT/CN2019/076181
§ 371 (c)(1),
(2) Date: Sep. 29, 2020

(87) PCT Pub. No.: WO2020/155259
PCT Pub. Date: Aug. 6, 2020

(65) Prior Publication Data

US 2021/0020130 A1 Jan. 21, 2021

(30) Foreign Application Priority Data

Jan. 30, 2019 (CN) ..... 201910097394.X

(51) Int. Cl.
*G09G 3/36* (2006.01)

(52) U.S. Cl.
CPC ..... *G09G 3/3614* (2013.01); *G09G 3/3677* (2013.01); *G09G 2300/0452* (2013.01);
(Continued)

(58) Field of Classification Search
CPC ... G09G 2300/0452; G09G 2310/0202; G09G 2310/08; G09G 2320/0242; G09G 3/3611; G09G 3/3614; G09G 3/3677
See application file for complete search history.

(56) References Cited

U.S. PATENT DOCUMENTS

2009/0109357 A1 4/2009 Liu et al.
2012/0287100 A1* 11/2012 Woo ..... G09G 3/3651 345/209

(Continued)

FOREIGN PATENT DOCUMENTS

CN 1866350 A 11/2006
CN 103728746 A 4/2014

(Continued)

OTHER PUBLICATIONS

First Office Action in counterpart Chinese Application No. 201910097394.X, dated Nov. 26, 2019.

(Continued)

*Primary Examiner* — Kenneth Bukowski

(57) ABSTRACT

Disclosed are a driving method including: acquiring a first preset scanning driving signal, a second preset scanning driving signal and a preset data driving signal, and shortening the driving time of the second preset scanning driving signal so as to shorten the driving time of the second preset scanning driving signal compared to the driving time of the preset data driving signal. The even-numbered column pixels in the first row and the odd-numbered column pixels in the second row in the driving period are driven by a first preset scanning driving signal, and the odd-numbered column pixels in the first row and the even-numbered column pixels in the second row in the driving period are driven by a second preset scanning driving signal.

10 Claims, 10 Drawing Sheets

(52) U.S. Cl.
CPC ..... *G09G 2310/0202* (2013.01); *G09G 2320/0242* (2013.01)

(56) References Cited

U.S. PATENT DOCUMENTS

| | | | | |
|---|---|---|---|---|
| 2015/0221265 | A1* | 8/2015 | Huang | G09G 3/3696 345/690 |
| 2016/0035265 | A1* | 2/2016 | Park | G09G 3/2092 345/694 |
| 2021/0201729 | A1* | 7/2021 | Huang | G09G 3/3614 |
| 2021/0366428 | A1* | 11/2021 | He | G09G 3/3614 |

FOREIGN PATENT DOCUMENTS

| | | | |
|---|---|---|---|
| CN | 105931591 | A | 9/2016 |
| CN | 107045858 | A | 8/2017 |
| CN | 107507575 | * | 12/2017 |
| CN | 107507575 | A | 12/2017 |
| CN | 107516494 | A | 12/2017 |
| CN | 107767832 | A | 3/2018 |
| CN | 107833562 | A | 3/2018 |
| CN | 107833564 | A | 3/2018 |
| CN | 107863082 | A | 3/2018 |
| CN | 107886923 | A | 4/2018 |

OTHER PUBLICATIONS

Second Office Action in counterpart Chinese Application No. 201910097394.X, dated May 11, 2020.
International Search Report in corresponding PCT Application No. PCT/CN2019/076181, dated Nov. 5, 2019.
Written Opinion of the International Searching Authority in corresponding PCT Application No. PCT/CN2019/076181, dated Nov. 5, 2019.

* cited by examiner

DRIVING METHOD FOR DISPLAY PANEL, DRIVING DEVICE OF DISPLAY PANEL, AND DISPLAY APPARATUS

CROSS-REFERENCE TO RELATED APPLICATIONS

The present application is the National Stage of International Application with No. PCT/CN2019/076181, filed Feb. 26, 2019, which claims the benefit of a Chinese patent application filed with the National Intellectual Property Administration on Jan. 30, 2019, with the application number 201910097394.X and the title "Driving method for display panel, driving device of display panel, and display apparatus", the entire contents of which are hereby incorporated by reference.

TECHNICAL FIELD

The present application relates to the technical field of liquid crystal display, and in particular to a driving method for a display panel, a driving device of a display panel, and a display apparatus.

BACKGROUND

The statements herein merely provide background information related to the present application and do not necessarily constitute prior art.

The existed large-size liquid crystal display panels mostly use negative Vertical Alignment (VA) liquid crystals or In-Plane Switching (IPS) liquid crystals.

It has been found that VA liquid crystal technology has higher production efficiency and lower manufacturing cost, compared with IPS liquid crystal technology, but its performance in optical properties is inferior to IPS liquid crystal technology and has obvious optical property defects.

The defects happen especially when the large-sized display panels are applied. If the display panel is viewed in a relatively small viewing angle in the driving process of the VA liquid crystal, for example, in front view, the pixel brightness will linearly change along with the voltage. If the display panel is viewed in a relatively larger viewing angle, the pixel brightness will rapidly saturate along with the voltage, severely deteriorating the image quality in the viewing angle. Obviously, there is no little difference between the ideal curve and the actual curve, which makes a serious change in the gray scale that should have been presented in a larger viewing angle because of the deterioration, resulting in color shift.

To improve the color shift regarding the VA liquid crystal, a general solution is to further divide subpixels into main pixels and sub-pixels. As such, the change in pixel brightness along with the voltage at a larger viewing angle is close to that at a smaller viewing angle.

However, the manner of division of the main pixel and the sub-pixel will solve the color shift by spatially providing a difference in driving voltages to the main pixel and the sub-pixel, but may also bring about the requirement of redesigning the metal traces or Thin Film Transistor (TFT) elements to drive the sub-pixel. The transparent opening area has to be sacrificed and the panel transmittance has been further affected.

For above, it is believed that the current solution for improving the color shift may not be a perfect one because of its negative influence on panel transmittance.

SUMMARY

The main purpose of the present application is to provide a driving method for a display panel, a driving device of a display panel, and a display apparatus, aiming at effectively improving the color shift without affecting the panel transmittance.

In order to achieve the objective aforementioned, the present application provides a driving method for a display panel, in which the display panel includes a display array which includes pixels arranged in an array, and each one of the pixels consists of three subpixels. The driving method includes:

acquiring a first preset scanning driving signal, a second preset scanning driving signal and a preset data driving signal, and shortening the driving time of the second preset scanning driving signal, to allow the driving time of the second preset scanning driving signal to be shortened compared with the driving time of the preset data driving signal;

taking having scanned two adjacent rows of subpixels as a driving period, driving the pixels in an even-numbered column of a first row and the pixels in an odd-numbered column in a second row by the first preset scanning driving signal in the driving period, and driving the pixels in an odd-numbered column of the first row and the pixels in an even-numbered column in the second row by the second preset scanning driving signal in the driving period.

In some embodiments, prior to acquiring the first preset scanning driving signal, the second preset scanning driving signal and the preset data driving signal, and shortening the driving time of the second preset scanning driving signal, to allow the driving time of the second preset scanning driving signal to be shortened compared with the driving time of the preset data driving signal, the method further includes:

setting polarity of two adjacent subpixels to be opposite.

In some embodiments, after taking having scanned two adjacent rows of subpixels as a driving period, driving the pixels in an even-numbered column of a first row and the pixels in an odd-numbered column in a second row by the first preset scanning driving signal in the driving period, and driving the pixels in an odd-numbered column of the first row and the pixels in an even-numbered column in the second row by the second preset scanning driving signal in the driving period, the method further includes:

driving the subpixels of a same column by a same data driving signal.

In some embodiments, after the same column of subpixels are driven with the same data driving signal, the method further includes:

driving the two adjacent subpixels of the same column by the preset data driving signal. The preset data driving signal is an average value of historical driving signals of the two adjacent subpixels.

In some embodiments, after acquiring a first preset scanning driving signal, a second preset scanning driving signal and a preset data driving signal, and shortening the driving time of the second preset scanning driving signal, to allow the driving time of the second preset scanning driving signal to be shortened compared to the driving time of the preset data driving signal, the method further includes:

receiving an inversion signal, reversing the first preset scanning driving signal and the preset data driving signal according to the inversion signal, obtaining the inverted first preset scanning driving signal and the inverted preset data driving signal, shortening driving time of the inverted first preset scanning driving signal, to allow the driving time of the first preset scanning driving signal to be shorten compared with the driving time of the inverted preset data driving signal.

In addition, in order to achieve the objective aforementioned, the present application provides a driving device of a display panel, in which the display panel includes a display array which includes pixels arranged in an array. Each one of the pixels consists of three subpixels. The driving device includes:

an acquiring circuit, configured to acquire a first preset scanning driving signal, a second preset scanning driving signal and a preset data driving signal, and shorten the driving time of the second preset scanning driving signal, to allow the driving time of the second preset scanning driving signal to be shortened compared with the driving time of the preset data driving signal;

a driving circuit, configured to take having scanned two adjacent rows of subpixels as a driving period, drive the pixels in an even-numbered column of a first row and the pixels in an odd-numbered column in a second row by the first preset scanning driving signal in the driving period, and drive the pixels in an odd-numbered column of the first row and the pixels in an even-numbered column in the second row by the second preset scanning driving signal in the driving period.

In addition, in order to achieve the objective aforementioned, the present application also provides a display apparatus, which includes: a display panel, a memory, a processor, and executable instructions of the display panel stored on the memory and operable on the processor. The display panel includes a display array including pixels arranged in an array, and each one of the pixels consists of three subpixels. The executable instructions of the display panel implement the operations of the driving method of the display panel as described above.

The present application acquires a first preset scanning driving signal, a second preset scanning driving signal and a preset data driving signal, shortens the driving time of the second preset scanning driving signal so as to shorten the driving time of the second preset scanning driving signal compared to the driving time of the preset data driving signal. It takes having scanned two adjacent rows of subpixels as a driving period, drives the even-numbered column pixels in the first row and odd-numbered column pixels in the second row in the driving period with a first preset scanning driving signal, and drives the odd-numbered column pixels in the first row and the even-numbered column pixels in the second row in the driving period with a second preset scanning driving signal. The present application creates a difference in the driving time of the two scanning driving signals, so as to enable a difference in charging capability of the sub-pixels on the two scanning driving signals. Thus driving of high voltage pixels and low voltage pixels with alternative arrangement in the display array can be realized, thereby alleviating color shift.

The implementation, functional characteristics and advantages of the present application will be further described with reference to the attached drawings in combination with embodiments.

DETAILED DESCRIPTION OF THE EMBODIMENTS

It should be understood that the specific embodiments described herein are only for the purpose of explaining the present application and are not intended to limit the present application.

Figure 1:
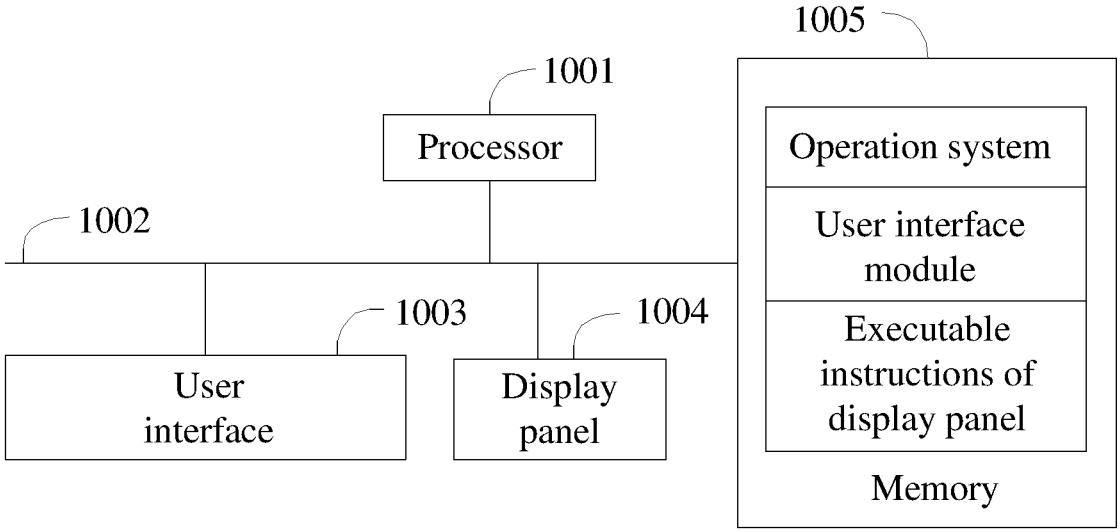
FIG. 1 is a system schematic diagram of the display apparatus including hardwares for operating in the display apparatus according to some embodiments of the present application.

Referring to FIG. 1, which is a schematic diagram showing a hardware operating environment of a display panel according to some embodiments of the present application.

As shown in FIG. 1, the display device may include a processor 1001, such as a CPU, a communication bus 1002, a user interface 1003, a display panel 1004, and a memory 1005. In which, the communication bus 1002 is configured to implement connection and communication between these components. The user interface 1003 may be configured to connect an input unit such as a keyboard. The memory 1005 may be a high speed RAM memory or a non-volatile memory such as a disk memory. The memory 1005 may alternatively be a storage device independent of the aforementioned processor 1001, and the display panel 1004 may be a liquid crystal display panel or other display panels with a same or similar functions.

It would be understood by those skilled in the art that the structure shown in FIG. 1 does not constitute a limitation to the display device, which may include more or fewer components than shown, or some components may be combined, or different components arranged.

As shown in FIG. 1, the memory 1005 as a storage medium may include an operating system, a user interface module and executable instructions for a display panel.

The display device of the present application calls an executable instruction of the display panel stored in the memory 1005 through the processor 1001 and executes a driving method of the display panel.

Based on the above hardware structure, embodiments of the driving method of the display panel of the present application are proposed.

Figure 2A:
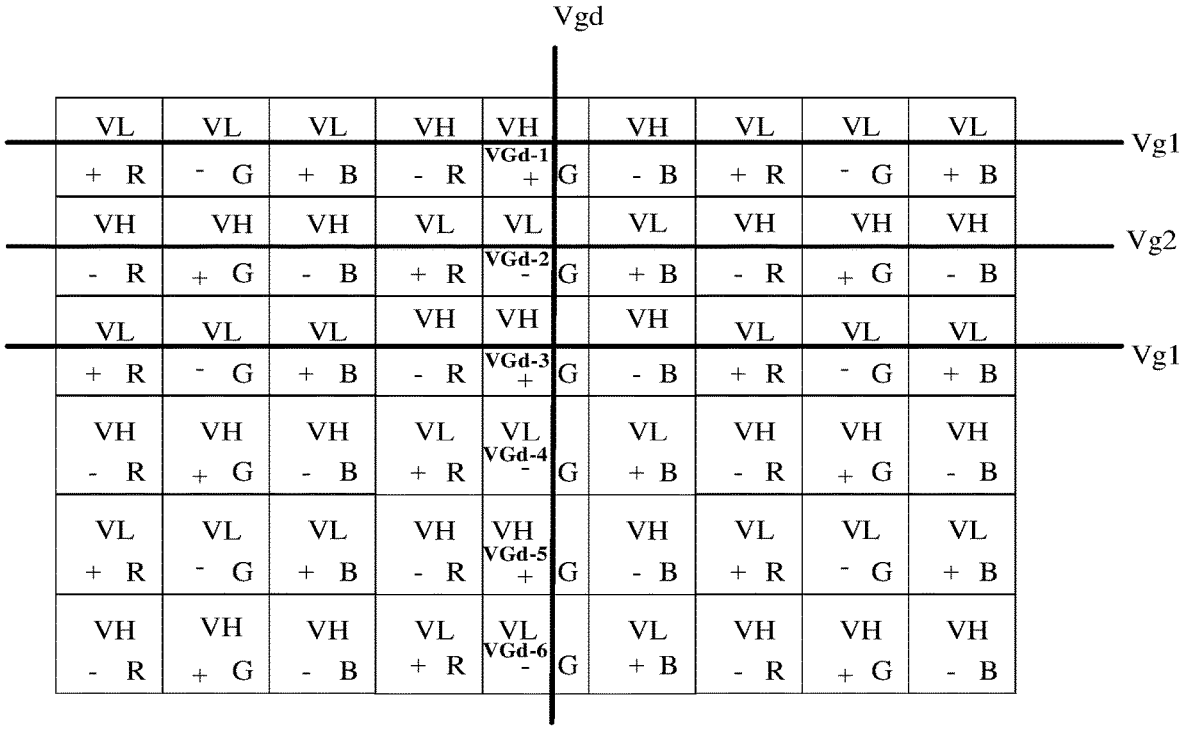
FIG. 2*a* is an exemplary schematic structural diagram of a display array.
Figure 2B:
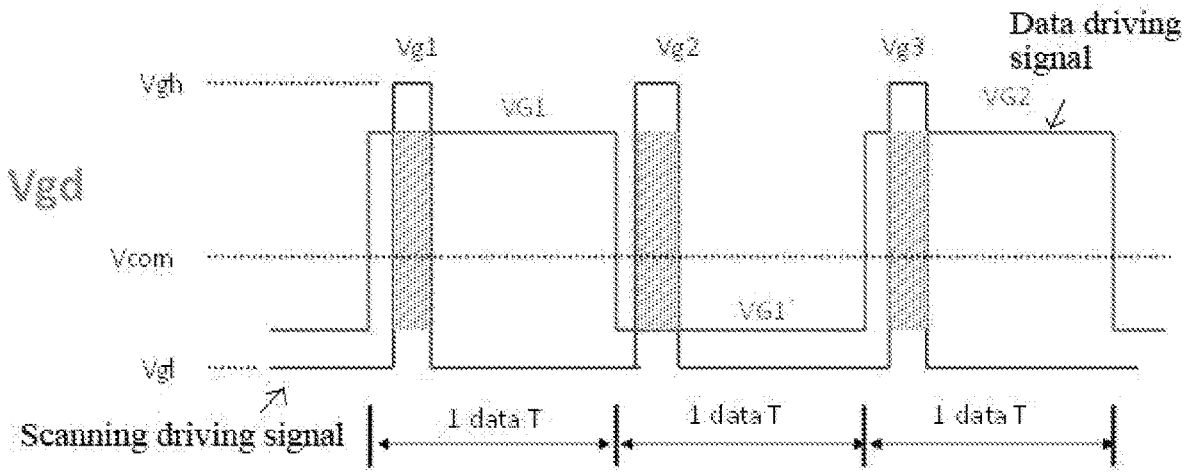
FIG. 2*b* is an exemplary schematic diagram of driving time sequence of the display array.

Referring to FIG. 2*a*, which is a schematic structural diagram of an exemplary display array. The original liquid crystal display panel designs the scanning driving signals to pass through the same row of subpixels, and each row of scanning driving signals is shown as the schematic drive time sequence diagram illustrated in FIG. 2*b*. In which, Vg1, Vg2, VG3, etc. indicate that a same driving voltage for each row of scanning driving signals, and the time sequence and overlapping time of the scanning driving signals with respect to the timing of the data driving signals are the same, and thus each subpixel has a same charging capability. In order to solve color shift, high-voltage subpixels and low-voltage subpixels are alternatively arranged in respect to driving. Therefore, the data driving voltage Vgd sequentially drives each subpixel with high and low voltages according to the requirements. For example, the subpixel is driven by the high-voltage driving voltage VGd_1 in FIG. 2*a*, while the next adjacent subpixel is driven by the low-voltage VGd_2. The same column of subpixels are sequentially driven by an alternative high-voltage and low-voltage signals. Besides the difference in driving signals, if the driving polarities of the two adjacent subpixels are different, the number of subpixels in the same row increases with the increase of panel resolution and, which will increase the driving frequency and the load of the driving IC, thus increasing load of the driving IC and the risk of temperature rise due to the IC consumption.

Figure 3A:
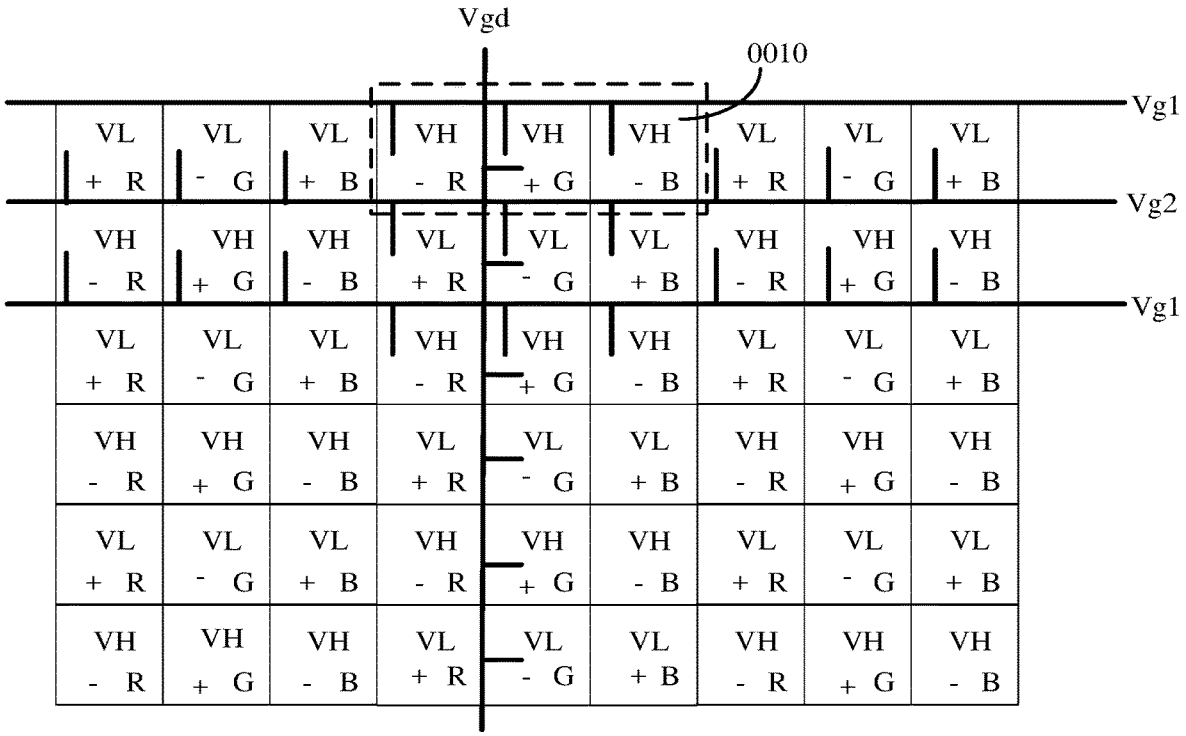
FIG. 3*a* is a schematic structural diagram of a display array according to some embodiments of the present application.
Figure 3B:
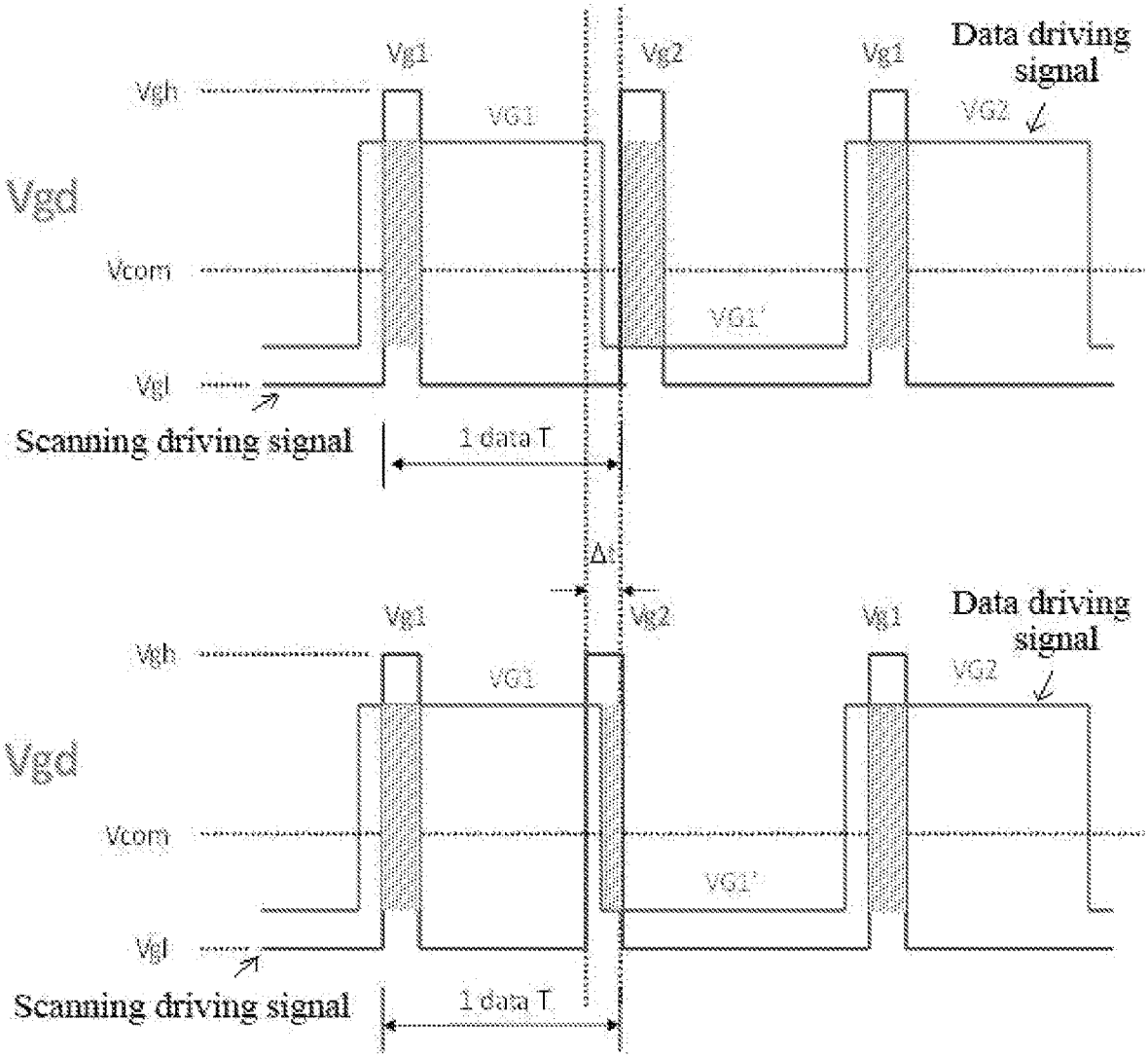
FIG. 3*b* is a schematic diagram of driving time sequence of the display array according to some embodiments of the present application.

Referring to FIG. 3*a*, which is a schematic structural diagram of the display array according to some embodiments of the present application, while FIG. 3*b* is a schematic diagram of the driving time sequence corresponding to the display array of these embodiments of the present application. The display panel of the display array may be a liquid crystal display panel or other display panels that can realize the same or similar functions. These embodiments are not limited thereto. In these embodiments, the liquid crystal display panel is taken as an example for illustration. The display panel includes a display array, which includes pixels arranged in an array. One single pixel consists of three subpixels 0010 (as shown in FIG. 3*a*), the pixel 0010 includes a first pixel and a second pixel, the first pixel and the second pixel are alternately arranged in a first direction and a second direction. The pixel includes a first subpixel, a second subpixel and a third subpixel, in which the first subpixel, the second subpixel and the third subpixel respectively correspond to red subpixel (R), green subpixel (G) and blue subpixel (Bb), wherein the second direction is the column direction.

Figure 4:
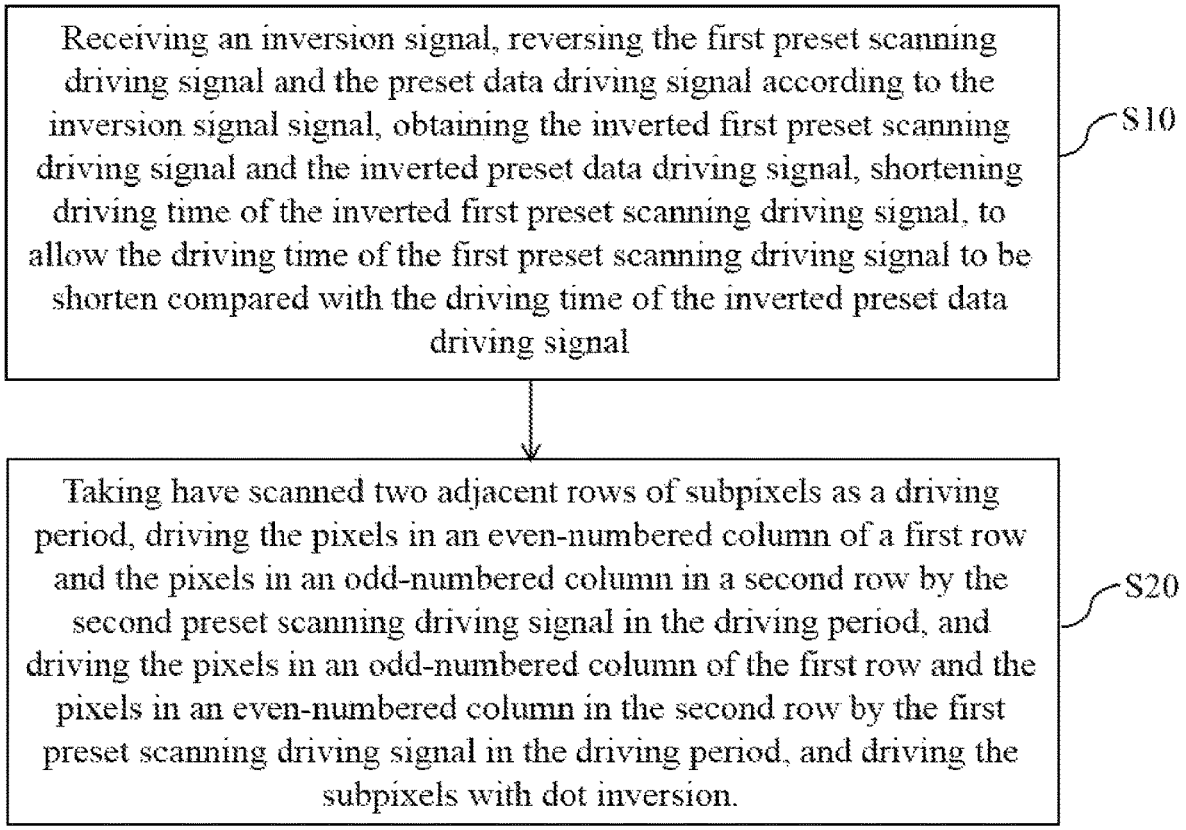
FIG. 4 is a schematic flow chart regarding a driving method for a display panel according to some embodiments of the present application.

Referring to FIG. 4, which is a schematic flow chart regarding a driving method for a display panel in some embodiments according to the present application.

In some embodiment, the driving method of the display panel includes:

Step S10, acquiring a first preset scanning driving signal, a second preset scanning driving signal and a preset data driving signal, and shortening the driving time of the second preset scanning driving signal, to allow the driving time of the second preset scanning driving signal to be shortened compared with the driving time of the preset data driving signal; and It should be noted that as shown in FIG. 3*a*, the first preset scan driving signal is Vg1, the second preset scan driving signal is Vg2, and the preset data driving signal is Vgd. "shortening the driving time of the second preset scan driving signal" means "shortening the driving time of the second preset scan driving signal comparatively to the preset data driving signal", as shown in T-Δt In FIG. 3*b*. The first preset time is the driving time T before improvement. As can be seen from the figure, the driving time of Vg2 is reduced by Δt relative to the preset data driving signal, so that the charging capacity of the two adjacent subpixels to the same column is different. The charging capacity of the sub-pixels associated with Vg2 is smaller than those associated with Vg1. As such, the two adjacent subpixels in the same column are alternately arranged by high voltage and low voltage.

Step S20, taking having scanned two adjacent rows of subpixels as a driving period, driving the pixels in an even-numbered column of a first row and the pixels in an odd-numbered column in a second row by the first preset scanning driving signal in the driving period, and driving the pixels in an odd-numbered column of the first row and the pixels in an even-numbered column in the second row by the second preset scanning driving signal in the driving period.

It should be noted that the voltage intensity of sub-pixels can be divided into low voltage (such as subpixels marked with L in FIGS. 2*a*, 3*a*, 3*c* and 6) and high voltage (such as subpixels marked with H in FIGS. 2*a*, 3*a*, 3*c* and 6).

It is understood that, the displayed gray scale associated with the subpixels with a high voltage is relatively bright, while displayed gray scale associated with the subpixels with a low voltage is relatively dark. As illustrated in FIG. 1, two adjacent pixels are arranged respectively and alternately with high and low voltage strengths.

As shown in FIG. 3*a* and its corresponding driving time sequence in FIG. 4*b*, in order to realize a pixel unit as R, G and B subpixels, each pixel unit is arranged alternatively in high voltage and low voltage. Vg1 is a common scanning driving circuit and scanning driving signal for pixels in a row of even-numbered column and pixels in an adjacent row of odd-numbered column. Vg2 is a common scanning driving circuit and scanning driving signal for pixels in a row of odd-numbered column and pixels in an adjacent row of even-numbered column. As is shown in the driving time sequence of FIG. 3*b*, dot inversion is adopted to control the time of scanning driving signal relative to data driving signal. The time of Vg2 relative to Vg1 changes from original T to T-Δt, and the charging time for subpixel on Vg2 decreases by Δt, so that the equivalent charging voltage of the corresponding this subpixel decreases and forms the so-called low voltage subpixel.

It can be understood that, the time for the scanning driving signal Vg2 is controlled shorter than that of the data driving signal. Compared with the time for the scanning switch timing of Vg1 which is longer, the charging capability can be deteriorated of the subpixel associated with the VG2 scanning driving line. And the charging capability of the subpixel associated with the Vg1 scanning line can be strengthened, thereby achieving the difference between the charging of the high voltage subpixel and the charging of the low voltage subpixel, and further improving the color shift.

In some embodiments, two scanning driving signals are used to drive pixels in two adjacent rows in an alternative manner, and the preset scanning driving signals in the scanning driving signals are driven by a target driving time relative to the preset data driving signals, so that the driving times of the two scanning driving signals have the difference. Thus the charging capabilities of subpixels on the two rows of scanning driving signals are different, implementing the alternative driving with high voltage and low voltage for pixels adjacent in a display array, and thereby alleviating color shift.

Optionally, before the step S10, the method further includes:

setting polarity of two adjacent subpixels to be opposite. And after Step S20, the method further includes:

driving the subpixels of a same column by a same data driving signal.

It can be understood that, as shown in FIG. 3*b*, the positive driving signals of the subpixels in column G are VG1, VG2, VG3 respectively, . . . , and the negative driving signals are VG1', VG2', VG3, respectively. According to the time sequence of first Frame, the equivalent driving voltage of subpixel VGd_1 is presented as high voltage the switching timing of the positive driving signal Vgd=VG1 and the scanning driving signal Vg1 is longer for the charging signal of the data driving signal. The next adjacent subpixel VGd_2 with low voltage has the negative driving voltage Vgd=VG1', and the switching timing of the scanning driving signal of Vg2 is shorter for the charging signal of the data driving signal, and the equivalent driving voltage of VGd_1 is larger than that of VGd_2. Similarly, the equivalent driving voltage of the high voltage subpixel VGd_3 is the positive driving signals Vgd=VG2 and Vg1 scanning driving signals, which is longer for the charging signals of the data driving signals, and the switching timing of the next adjacent low-voltage sub-pixel VGd_4 is the switching timing of the negative driving voltages Vgd=VG2' and Vg2 scanning driving signals, which is shorter for the charging signals of the data driving signals, and the equivalent driving voltage VGd_3>VGd_4, so that the adjacent sub-pixels in the same column are driven in a driving mode of high-low voltage alternating arrangement, thereby achieving the purpose of reducing color shift.

Optionally, after the same column of subpixels are driven with the same data driving signal, the method further includes:

driving the two adjacent subpixels of the same column by the preset data driving signal. The preset data driving signal is an average value of historical driving signals of the two adjacent subpixels.

It should be noted that the historical driving signals of the two adjacent subpixels of the same column are the driving signals of the two adjacent subpixels to the same column before improvement. The equivalent driving voltages VGd_1 and VGd_2 of the two adjacent subpixels of the same column are respectively driven by the positive driving voltage Vgd=VG1 and the negative driving voltage Vgd=VG1'. And the positive driving voltage VG1 and negative driving voltage VG1' can be selected as the average signals of the original display array pixel signals Gd1 and Gd2, which is 0-255 signals in terms of 8 bit driving signals, namely G1=(Gd1+Gd2)/2, corresponding to the positive driving voltage VG1 and negative driving voltage VG1'. The equivalent voltages of VGd_3 and VGd_4 are respectively driven by the positive driving voltage Vgd=VG2 and the negative driving voltage Vgd=VG2', and can be selected as the average signals of the pixel signals Gd3 and Gd4 in the original frame (0-255 signals in terms of 8-bit driving signals), namely G2=(Gd3+Gd4)/2, which is corresponding to the positive driving voltage VG2 and the negative driving voltage VG2'.

Optionally, after the step S10, the method further includes:

receiving an inversion signal, reversing the first preset scanning driving signal and the preset data driving signal according to the inversion signal, obtaining the inverted first preset scanning driving signal and the inverted preset data driving signal, shortening driving time of the inverted first preset scanning driving signal, to allow the driving time of the first preset scanning driving signal to be shorten compared with the driving time of the inverted preset data driving signal.

Figure 3C:
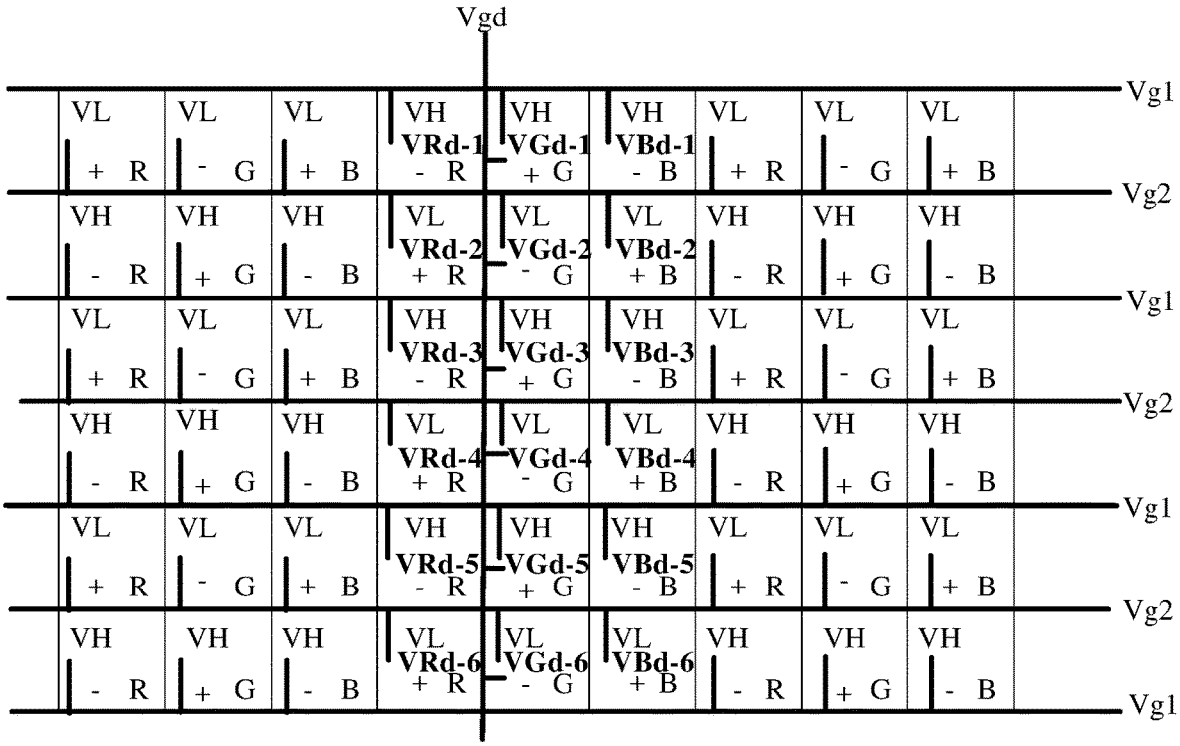
FIG. 3*c* is a schematic structural diagram of a display array according to some other embodiments of the present application.

Referring to the timing sequence shown in FIG. 4*b* and combining with FIG. 3*c*, the G column subpixels in the figure are the same, so as the R and B column subpixels. The scanning driving voltages associated with the high voltage subpixels VGd_1, VGd_3, VGd_5 are Vg1 while the scanning driving voltages corresponding to the low voltage subpixel VGd_2, VGd_4, VGd_6 are Vg2. In which, the switching time of the scanning driving signal Vg1 is longer than the data driving signal VG1, but shorter than VG1', which is a charging signal of data driving signal associated with the scanning driving signal Vg2.

Figure 5:
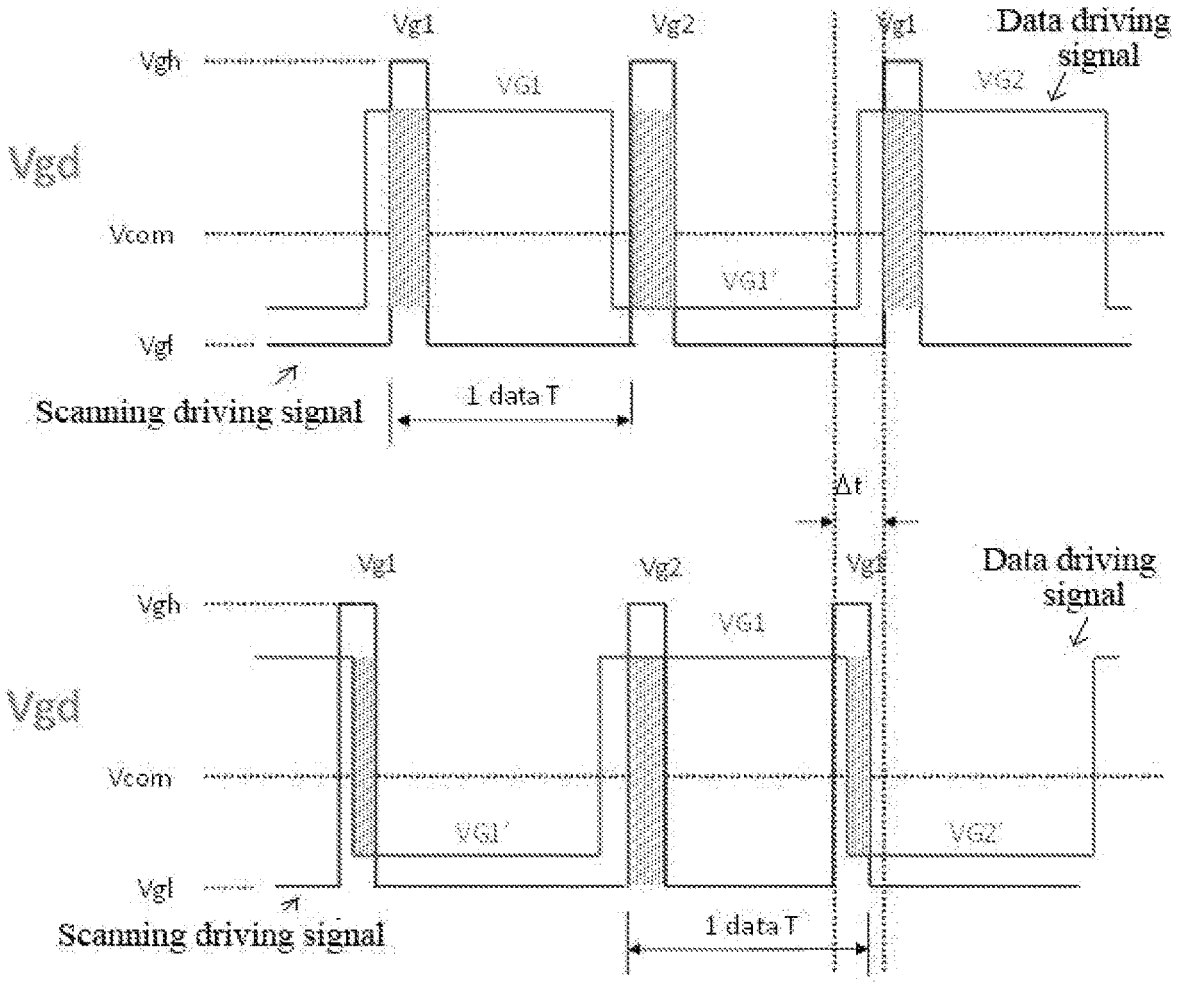
FIG. 5 is a schematic diagram of a driving sequence after inversion according to some embodiments of the present application.

In some embodiments, the inversion of the driving signals of the adjacent two frames in the display array is shown in FIG. 5. The scanning driving signal for the charging of the data driving signal is controlled and switched, i.e., the scanning driving signal Vg1 is shorter compared to the correct charging signal VG1' of the data driving signal, but longer compared to the charging signal VG1 of the data driving signal associated with the scanning driving signal Vg2, thus realizing subpixels with high and low voltage signals with different timing. The difference between the high voltage subpixel and the low voltage subpixel will not be distinguished by the naked eye, and the flaw of decreasing resolution would not be detected.

Optionally, the pixel includes a first pixel and a second pixel which are alternately arranged in a column direction, in which the first pixel is sequentially a red subpixel, a green subpixel, a blue subpixel and a white subpixel, and the second pixel comprises sequentially arranged a blue subpixel, a white subpixel, a red subpixel and a green subpixel.

Optionally, the step S20 includes:

taking having scanned two adjacent rows of subpixels as a driving period, driving the pixels in an even-numbered column of a first row and the pixels in an odd-numbered column in a second row by the second preset scanning driving signal in the driving period, and driving the pixels in an odd-numbered column of the first row and the pixels in an even-numbered column in the second row by the first preset scanning driving signal in the driving period, and driving the subpixels with dot inversion.

Figure 6:
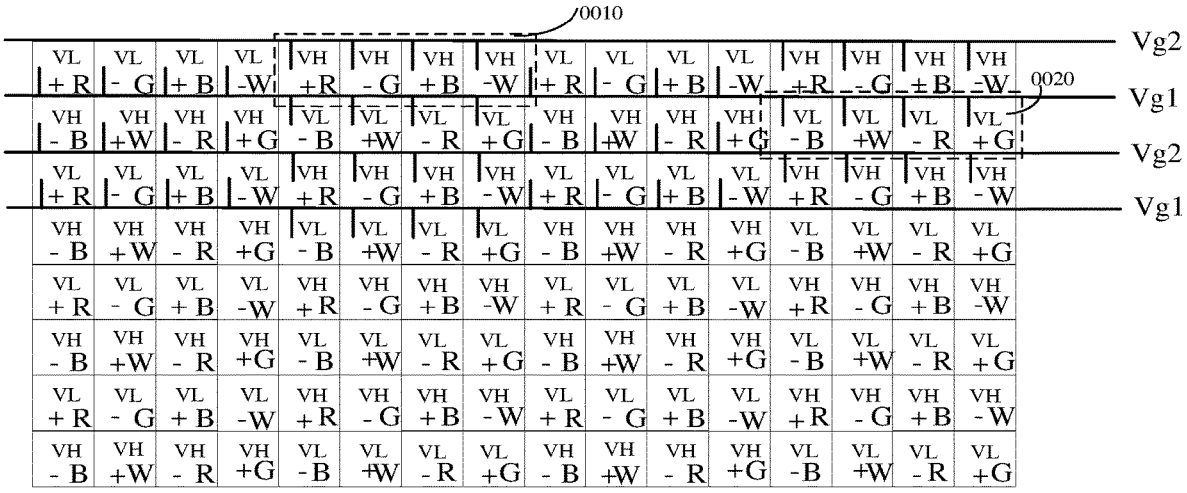
FIG. 6 is a schematic structural diagram of a display array according to some other embodiments of the present application.

As shown in FIG. 6, it is proposed to use WRGB subpixels driven by high and low voltage to improve color shift. Vg1 and Vg2 are driven for the subpixels in the same row, while the preset data driving signal Vgd are driven for the subpixels in the same column. The first pixel 0010 use RGBW four subpixels in sequence, and BWRG four subpixels in sequence as the second pixel 0020. The first pixel and the second pixel are arranged alternatively in sequence. Referring to FIG. 6, the first row of subpixels in one driving period is composed of the first pixel consisting of RGBW subpixels and the second row of subpixels is composed of the second pixel consisting of BWRG subpixels. And dot inversion is adopted to drive the pixels, so that each pixel unit presents high and low voltage with an alternate arrangement to alleviate color shift.

Figure 7:
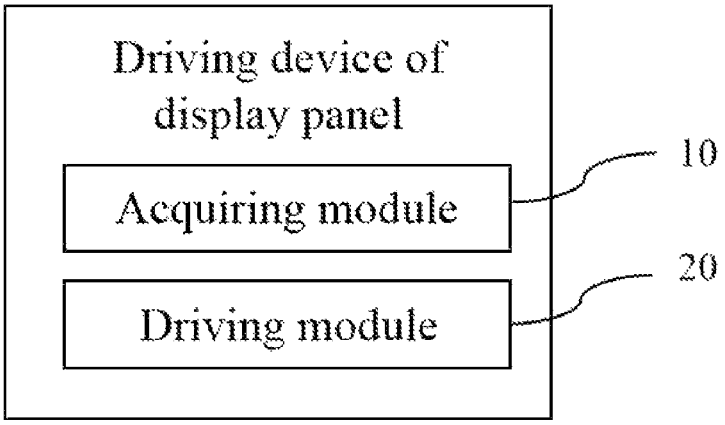
FIG. 7 is a structural schematic diagram of the display device according to some embodiments of the present application.

In addition, the embodiments of the present application also provide a driving device of the display panel. As shown in FIG. 7, the display panel includes a display array which includes pixels arranged in an array. Each one of the pixels consists of three subpixels. The driving device includes:

an acquiring circuit 110, configured to acquire a first preset scanning driving signal, a second preset scanning driving signal and a preset data driving signal, and shorten the driving time of the second preset scanning driving signal, to allow the driving time of the second preset scanning driving signal to be shortened compared with the driving time of the preset data driving signal; and a driving circuit 120, configured to take having scanned two adjacent rows of subpixels as a driving period, drive the pixels in an even-numbered column of a first row and the pixels in an odd-numbered column in a second row by the first preset scanning driving signal in the driving period, and drive the pixels in an odd-numbered column of the first row and the pixels in an even-numbered column in the second row by the second preset scanning driving signal in the driving period.

Optionally, the polarity of two adjacent subpixels are set to be opposite.

Optionally, the driving circuit is configured to drive the subpixels of a same column by a same data driving signal.

Optionally, the driving circuit is further configured to drive the two adjacent subpixels of the same column by the preset data driving signal. The preset data driving signal is an average value of historical driving signals of the two adjacent subpixels.

Optionally, the acquiring circuit is further configured to receive an inversion signal, reverse the first preset scanning driving signal and the preset data driving signal according to the inversion signal, obtain the inverted first preset scanning driving signal and the inverted preset data driving signal, shorten driving time of the inverted first preset scanning driving signal, to allow the driving time of the first preset scanning driving signal to be shorten compared with the driving time of the inverted preset data driving signal.

Optionally, the pixel comprises a first pixel and a second pixel which are alternately arranged in a column direction, wherein the first pixel is sequentially a red subpixel, a green subpixel, a blue subpixel and a white subpixel, and the second pixel comprises sequentially arranged a blue subpixel, a white subpixel, a red subpixel and a green subpixel.

The driving circuit is further configured to take having scanned two adjacent rows of subpixels as a driving period, drive the pixels in an even-numbered column of a first row and the pixels in an odd-numbered column in a second row by the second preset scanning driving signal in the driving period, and drive the pixels in an odd-numbered column of the first row and the pixels in an even-numbered column in the second row by the first preset scanning driving signal in the driving period, and drive the subpixels with dot inversion.

Optionally, the driving circuit 200 of the driving device of the display panel may include a scanning unit and a driving unit, in which the scanning unit is configured to output the scanning driving signals, to generally scan pixels line by line, and the driving unit is configured to output the data driving signals, so that the pixels receive driving data for displaying when being scanned.

The specific embodiment of the driving device of this embodiment can refer to the above-mentioned embodiment of the driving method of the display panel, and this embodiment will not be described here.

The description aforementioned is only the preferred embodiment of the present application and is not intended to limit the scope of the present application. Any equivalent structural modification made by using the description and drawings of the present application or direct/indirect application in other related technical fields under the concept of the present application shall be included in the protection scope of the present application.

What is claimed is:

1. A driving method for a display panel, wherein the display panel comprises:

a display array comprising pixels arranged in an array, each one of the pixels consisting of three subpixels;

wherein the driving method comprises:

acquiring a first preset scanning driving signal, a second preset scanning driving signal and a preset data driving signal, setting polarity of two adjacent subpixels to be opposite, wherein the first preset scanning driving signal corresponds to sub-pixels of a positive polarity driving voltage, the second preset scanning driving signal corresponds to sub-pixels of a negative polarity driving voltage;

driving time of the positive polarity driving voltage of sub-pixels with respect to the preset data driving signal being the same as that of the negative polarity driving voltage of sub-pixels with respect to the preset data driving signal;

in comparison with a driving time of the first preset scanning driving signal with respect to the preset data driving signal, shortening a driving time of the second preset scanning driving signal with respect to the preset data driving signal, to make a charging time of the second preset scanning driving signal with respect to the preset data driving signal less than a charging time of the first preset scanning driving signal with respect to the preset data driving signal;

taking time of scanning two adjacent rows of subpixels as a driving period, driving pixels in an even-numbered column of a first row and pixels in an odd-numbered column in a second row by the first preset scanning driving signal in the driving period, and driving pixels in an odd-numbered column of the first row and pixels in an even-numbered column in the second row by the second preset scanning driving signal in the driving period;

driving subpixels of a same column by a same data driving signal; and driving the two adjacent subpixels of the same column by the preset data driving signal, the preset data driving signal being an average value of historical driving signals of the two adjacent subpixels.

2. The driving method of claim 1, wherein after acquiring a first preset scanning driving signal, a second preset scanning driving signal and a preset data driving signal, and shortening the driving time of the second preset scanning driving signal, to allow the driving time of the second preset scanning driving signal to be shortened compared with the drive time of the preset data driving signal, the driving method further comprises:

receiving an inversion signal, reversing the first preset scanning driving signal and the preset data driving signal according to the inversion signal, obtaining the inverted first preset scanning driving signal and the inverted preset data driving signal, shortening a driving time of the inverted first preset scanning driving signal, to allow the driving time of the first preset scanning driving signal to be shorten compared with a driving time of the inverted preset data driving signal.

3. The driving method of claim 1, wherein the pixels comprise a first pixel and a second pixel which are alternately arranged in a column direction, wherein the first pixel is sequentially a red subpixel, a green subpixel, a blue subpixel and a white subpixel, and the second pixel comprises sequentially arranged a blue subpixel, a white subpixel, a red subpixel and a green subpixel;

taking time of scanning two adjacent rows of subpixels as a driving period, driving pixels in an even-numbered column of a first row and pixels in an odd-numbered column in a second row by the first preset scanning driving signal in the driving period, and driving pixels in an odd-numbered column of the first row and pixels in an even-numbered column in the second row by the second preset scanning driving signal in the driving period, comprises:

taking the time of scanning two adjacent rows of subpixels as the driving period, driving the pixels in the even-numbered column of the first row and the pixels in the odd-numbered column in the second row by the second preset scanning driving signal in the driving period, and driving the pixels in the odd-numbered column of the first row and the pixels in the even-numbered column in the second row by the first preset scanning driving signal in the driving period, and driving the subpixels with dot inversion;

wherein the first row is composed of the first pixel consisting of subpixels and the second row of subpixels is composed of the second pixel consisting of subpixels.

4. A driving device of a display panel, wherein the display panel comprises a display array comprising pixels arranged in an array, each one of the pixels consisting of three subpixels;

wherein the driving device comprises:

an acquiring circuit, configured to perform:

acquire a first preset scanning driving signal, a second preset scanning driving signal and a preset data driving signal, set polarity of two adjacent subpixels to be opposite, wherein the first preset scanning driving signal corresponds to sub-pixels of a positive polarity driving voltage, the second preset scanning driving signal corresponds to sub-pixels of a negative polarity driving voltage;

drive time of the positive polarity driving voltage of sub-pixels with respect to the preset data driving signal being the same as that of the negative polarity driving voltage of sub-pixels with respect to the preset data driving signal; and in comparison with a driving time of the first preset scanning driving signal with respect to the preset data driving signal, shorten a driving time of the second preset scanning driving signal with respect to the preset data driving signal, to make a charging time of the second preset scanning driving signal with respect to the preset data driving signal less than a charging time of the first preset scanning driving signal with respect to the preset data driving signal;

a driving circuit, configured to perform:

take time of scanning two adjacent rows of subpixels as a driving period, drive pixels in an even-numbered column of a first row and pixels in an odd-numbered column in a second row by the first preset scanning driving signal in the driving period, and drive pixels in an odd-numbered column of the first row and the pixels in an even-numbered column in the second row by the second preset scanning driving signal in the driving period;

drive subpixels of a same column by a same data driving signal; and drive the two adjacent subpixels of the same column by the preset data driving signal, the preset data driving signal being an average value of historical driving signals of the two adjacent subpixels.

5. The driving device of claim 4, wherein the acquiring circuit is further configured to receive an inversion signal, reverse the first preset scanning driving signal and the preset data driving signal according to the inversion signal, obtain the inverted first preset scanning driving signal and the inverted preset data driving signal, shorten a driving time of the inverted first preset scanning driving signal, to allow the driving time of the first preset scanning driving signal to be shorten compared with a driving time of the inverted preset data driving signal.

6. The driving device of claim 4, wherein the pixel comprises a first pixel and a second pixel which are alternately arranged in a column direction, wherein the first pixel is sequentially a red subpixel, a green subpixel, a blue subpixel and a white subpixel, and the second pixel comprises sequentially arranged a blue subpixel, a white subpixel, a red subpixel and a green subpixel; and the driving circuit is further configured to take the time of scanning two adjacent rows of subpixels as the driving period, drive the pixels in the even-numbered column of the first row and the pixels in the odd-numbered column in the second row by the second preset scanning driving signal in the driving period, and drive pixels in an odd-numbered column of the first row and the pixels in an even-numbered column in the second row by the first preset scanning driving signal in the driving period, and drive the subpixels with dot inversion;

wherein the first row is composed of the first pixel consisting of subpixels and the second row of subpixels is composed of the second pixel consisting of subpixels.

7. A display apparatus, comprising: a display panel, a memory, a processor and executable instructions of the display panel, wherein the executable instructions of the display panel are stored on the memory and operable on the processor, the display panel comprising a display array comprising pixels arranged in an array, each one of the pixels consisting of three subpixels, and the processor executing the executable instructions, and the executable instructions comprising:

acquiring a first preset scanning driving signal, a second preset scanning driving signal and a preset data driving signal, setting polarity of two adjacent subpixels to be opposite, wherein the first preset scanning driving signal corresponds to sub-pixels of a positive polarity driving voltage, the second preset scanning driving signal corresponds to sub-pixels of a negative polarity driving voltage;

driving time of the positive polarity driving voltage of sub-pixels with respect to the preset data driving signal being the same as that of the negative polarity driving voltage of sub-pixels with respect to the preset data driving signal;

in comparison with a driving time of the first preset scanning driving signal with respect to the preset data driving signal, shortening a driving time of the second preset scanning driving signal with respect to the preset data driving signal, to make a charging time of the second preset scanning driving signal with respect to the preset data driving signal less than a charging time of the first preset scanning driving signal with respect to the preset data driving signal;

taking time of scanning two adjacent rows of subpixels as a driving period, driving pixels in an even-numbered column of a first row and pixels in an odd-numbered column in a second row by the first preset scanning driving signal in the driving period, and driving pixels in an odd-numbered column of the first row and pixels in an even-numbered column in the second row by the second preset scanning driving signal in the driving period;

driving subpixels of a same column by a same data driving signal; and driving the two adjacent subpixels of the same column by the preset data driving signal, the preset data driving signal being an average value of historical driving signals of the two adjacent subpixels.

8. The display apparatus of claim 7, wherein the executable instructions comprise:

receiving an inversion signal, reversing the first preset scanning driving signal and the preset data driving signal according to the inversion signal, obtaining the inverted first preset scanning driving signal and the inverted preset data driving signal, shortening a driving time of the inverted first preset scanning driving signal, to allow the driving time of the first preset scanning driving signal to be shorten compared with a driving time of the inverted preset data driving signal.

9. The driving apparatus of claim 7, wherein the pixel comprises a first pixel and a second pixel which are alternately arranged in a column direction, wherein the first pixel is sequentially a red subpixel, a green subpixel, a blue subpixel and a white subpixel, and the second pixel comprises sequentially arranged a blue subpixel, a white subpixel, a red subpixel and a green subpixel.

10. The display apparatus of claim 9, wherein the executable instructions comprise:

taking the time of scanning two adjacent rows of subpixels as the driving period, driving the pixels in the even-numbered column of the first row and the pixels in the odd-numbered column in the second row by the second preset scanning driving signal in the driving period, and driving the pixels in the odd-numbered column of the first row and the pixels in the even-numbered column in the second row by the first preset scanning driving signal in the driving period, and driving the subpixels with dot inversion;

wherein the first row is composed of the first pixel consisting of subpixels and the second row of subpixels is composed of the second pixel consisting of subpixels.

* * * * *